United States Patent [19]

Elder

[11] 4,123,926

[45] Nov. 7, 1978

[54] REMOVABLE CORE CYLINDER LOCK

[75] Inventor: George Elder, Woodside, Calif.

[73] Assignee: Schlage Lock Company, San Francisco, Calif.

[21] Appl. No.: 813,164

[22] Filed: Jul. 5, 1977

[51] Int. Cl.[2] ..... E05B 9/04; E05B 27/04

[52] U.S. Cl. ..... 70/369; 70/373; 70/375

[58] Field of Search ..... 70/367, 368, 369, 370, 70/373, 375, 364 A

[56] References Cited

U.S. PATENT DOCUMENTS

| | | | |
|---|---|---|---|
| 1,565,558 | 12/1925 | Fremon | 70/375 |
| 2,347,802 | 5/1944 | Voight | 70/369 |

*Primary Examiner*—Robert L. Wolfe
*Attorney, Agent, or Firm*—Lothrop & West

[57] ABSTRACT

For use in a lockset there is provided a cylindrical housing having a projecting wing and having a bore concentric with an axis. An axially extending rib projects into the bore. A first tumbler mechanism is disposed largely in the wing portion of the housing and includes first tumbler chambers extending through the rib to the bore. A plug is rotatable in the housing about the axis. The plug includes a plug shell and a plug core normally interfitted and axially separable. The plug shell has an axially extending recess therein open at one end. The plug has an adjustable cap adjacent one end and a disc on the other end to limit axial movement. The plug core has a second tumbler mechanism cooperating with the first tumbler mechanism and opening into a keyway therein. The plug core is receivable in the plug shell recess and has a lug on the end opposite the disc interengaging with an inturned flange on the housing to limit withdrawal movement of the plug core in all except one rotary position. In that position, a window in the inturned flange passes the lug and permits retraction of the plug core.

24 Claims, 14 Drawing Figures

13
14
16
16
~2~
~3~
17
12
47
7
17
11
51
31
57
63
65
48
62
64
62
62
64
9
36
41
42
50
53
33
32
26
8
6
66
~2~
~3~

14
7
58
21
~4~
67
59
37
6
36
26
73
76
49
38
72
26
51
12
53
33
63
32
4~

14
13
16
7
17
65
21
24
22
23
27
6
62
94
92
26
93
91
36
38
32
51
33
63

REMOVABLE CORE CYLINDER LOCK

A sleeve is interposed between the plug and the housing, surrounds the plug core and the plug shell, and normally is held against rotation by an axially extending slot, the margins of which lie on opposite sides of the housing rib. The sleeve can be withdrawn axially with the plug core when the lug on the plug core passes through the window in the housing flange, and then serves to keep the second tumbler mechanism in place. One form of key utilized in the keyway has a transverse notch interengaging with the inturned flange tab and precludes axial withdrawal of the plug core and sleeve from the plug shell and housing. Another key utilized in the keyway has a cut-away portion clearing the inturned flange. When that key and the plug are turned to a predetermined rotary position, with the lug on the plug core in alignment with the window in the inturned flange on the housing, the key serves to withdraw the plug core and the sleeve, as a unit, from the housing. An interlocking pin holds the plug shell within the housing despite withdrawal of the plug core and sleeve.

BRIEF SUMMARY OF THE INVENTION

In many lockset installations on door panels and the like it is often desired to change the combination of the key lock itself, or to provide a different arrangement to receive a newly acceptable key and to reject previously operable keys. This is done to accommodate changes in usage of an otherwise suitable, installed lockset. An early version of such a device, as shown in U.S. Pat. No. 1,575,092 issued Mar. 2, 1926 to Frank Ellison Best, utilizes two lock mechanisms, each provided with its own key. One key serves to actuate the door lock bolt, and the other key serves to release the first key mechanism from its mounting in the lockset. In this arrangement there are two keyways and two key plugs visible and accessible from the exterior of the lockset.

Such arrangement has been successful in many instances, but it is still desirable to provide a lock mechanism in which the key accepting portion, at least, can be changed from time to time by authorized people and in a somewhat simpler fashion than heretofore. It is also beneficial to have an arrangement in which the external appearance of the mechanism is no different from that of a standard, nonchangeable lock.

There is also a requirement to provide a changeable mechanism that can be incorporated within locksets that are already constructed and are standard in dimensions and arrangement. It is also desirable to have a changeable lock that is generally improved over those previously available.

These general aims are accomplished by having a lock mechanism in which the plug portion is rearranged to comprise two principal parts axially separable under appropriate circumstances and by utilization of an appropriate key so that at least a part of the tumbler mechanism controlling the utilization of the lock can be withdrawn and replaced by a unit with a different combination to accommodate a different key.

DETAILED DESCRIPTION

Figure 1:
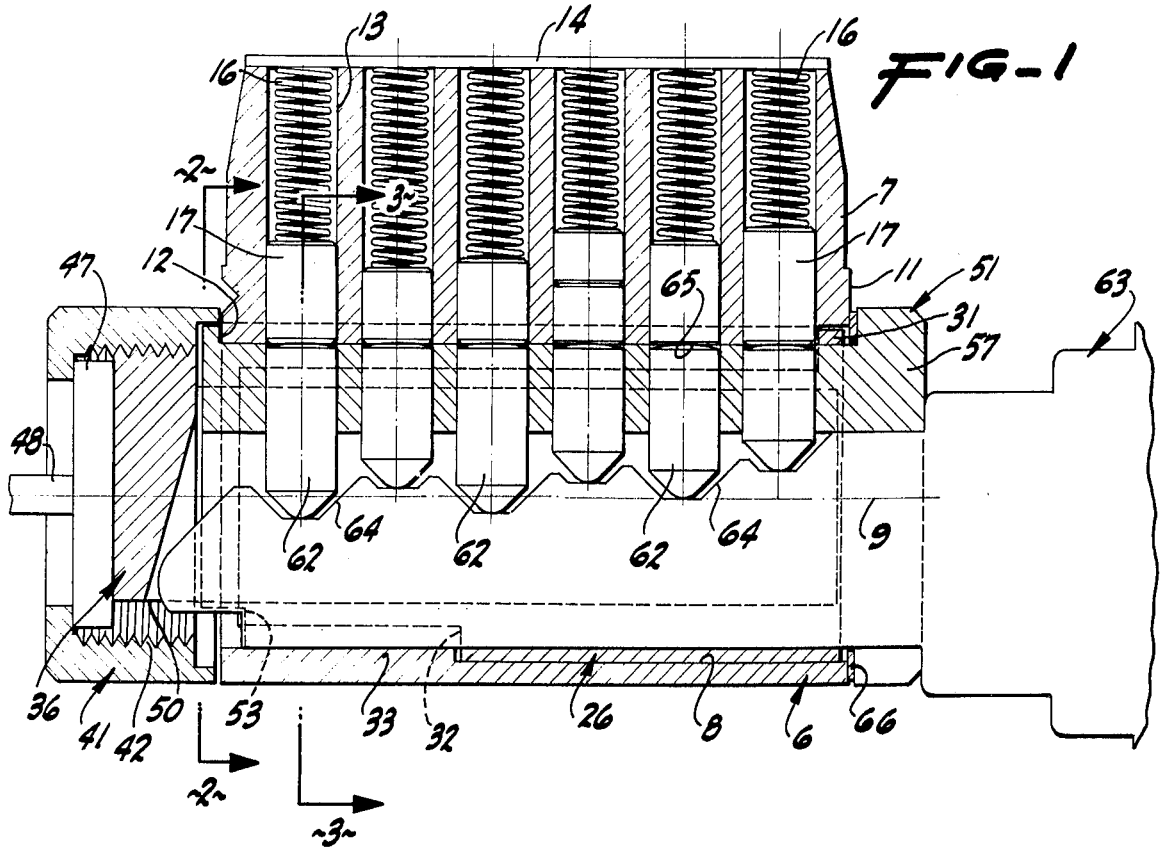
FIG. 1 is an axial cross-section through one form of cylindrical lock mechanism pursuant to the invention, the key for effecting removal of part of the combination structure being shown in inserted position and before any rotation.
Figure 2:
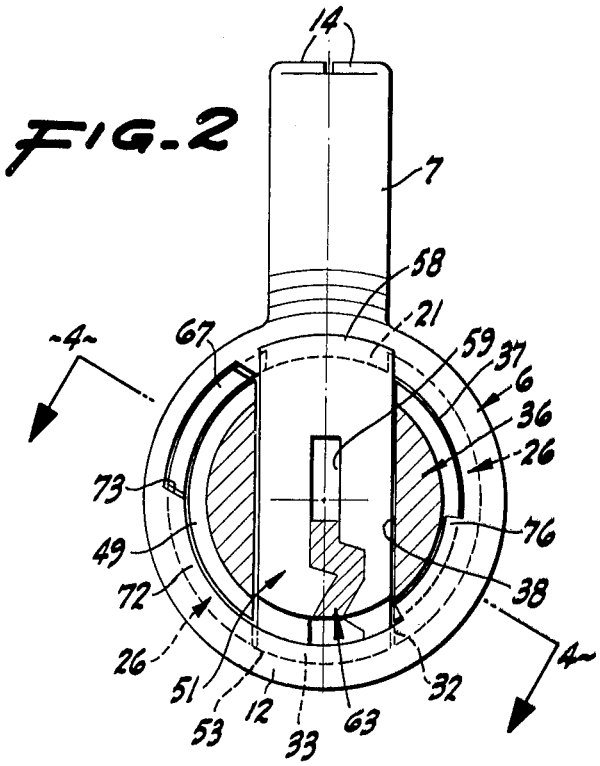
FIG. 2 is a cross-section, the plane of which is indicated by line 2—2 of FIG. 1.

In an embodiment of the invention that has proved practical and successful, there is provided a lock housing 6 similar to those customarily used. This is generally circular-cylindrical in exterior envelope and is especially provided with an axial wing 7 extending therefrom in a radial direction. The housing has an almost entirely circular-cylindrical bore 8 therethrough, the bore being concentric with an axis 9. The housing is finished on opposite ends with flat surfaces 11 and 12 normal to the axis 9.

Arranged in the wing 7 is a first tumbler mechanism inclusive of one or more first chambers 13 extending normal to the axis 9 and having their axes coplanar. Conveniently, the chambers are closed at their outermost ends by in-folded flanges 14 on the housing. Within each of the first chambers 13 is a spring 16 expanding toward the axis 9 and bearing against an upper tumbler pin 17. The chambers 13 open into the bore 8 and unless restrained the pins 17 can project into the bore.

On the interior of the bore is an axially extending rib 21 having side edges 22 and 23 parallel to the axis. The rib is defined also by a coaxial, circular-cylindrical surface 24. The lower portions of the chambers 13 open through the rib.

Received in the housing is a sleeve 26 circular-cylindrical on its exterior and on its interior and having a radial thickness about equal to that of the rib 21. The sleeve has an axially extending slot 27 therein arranged so that its side edges 28 and 29 abut the edges 22 and 23 of the rib when the sleeve is positioned coaxially with the housing. The slot does not extend for the entire length of the sleeve, but stops to leave a solid bridge 31 at one end spanning the adjacent end of the rib 21. The sleeve 26 also has a short slot 32 opposite to and balancing the slot 27. The short slot 32 lies around a pad 33 within the bore and complementing the rib. The sleeve 26 is slightly shorter than the housing and in some respects serves as a lining for the housing.

Adapted to be disposed within the sleeve is a composite plug akin to a standard plug but including two main portions. Considered as one portion is a plug shell 36 having a circular-cylindrical outside surface 37 fitting neatly within the sleeve 26. The plug shell has a diametrically disposed recess 38 extending axially for much of the length of the shell and leaving one end open. At the closed end of the plug shell is a threaded portion 39 designed to receive an adjusting cap 41 having internal threads 42 engaging the external threads 43 of the plug shell. There is an end flange 44 on the adjusting cap 41 provided with serrations 46 to receive a locking mechanism. This holds the adjusting cap in relationship to a driving disc 47 and a driver bar 48 for operating the usual lockset bolt, all as shown in the Ernest L. Schlage U.S. Pat. No. 2,803,959 issued Aug. 27, 1957. In this way the driver bar 48 is secured for rotation with the plug shell 36. Adjacent the inner end of the threads 39 there is a circumferential groove 49 around the plug shell, and in line with the recess 38 is a slot 50 intersecting the groove 49.

Considered as part of a composite plug and complementing the plug shell 36 is a plug core 51. This includes a central body having circular-cylindrical surfaces 52 and 53 and planar side surfaces 54 and 56. At one end the plug core has an outstanding disc 57 and at the other end the plug core has an upstanding partial lug 58 opposite a cut-away portion. Within the plug core is the customary kind of keyway 59 extending entirely therethrough. There is also a second tumbler mechanism inclusive of chambers 61 extending from the surface 52 into the keyway 59. Each chamber contains a lower tumbler pin 62 designed to cooperate with an appropriate key 63 in the keyway 59 and in one position of the parts to cooperate with the opposite one of the upper pins 17. The serrations 64 of the key are such that when the key is in initial position the various pins, upper and lower, align themselves to afford a common shear surface 65 (FIG. 1) in the usual fashion.

Figure 14:
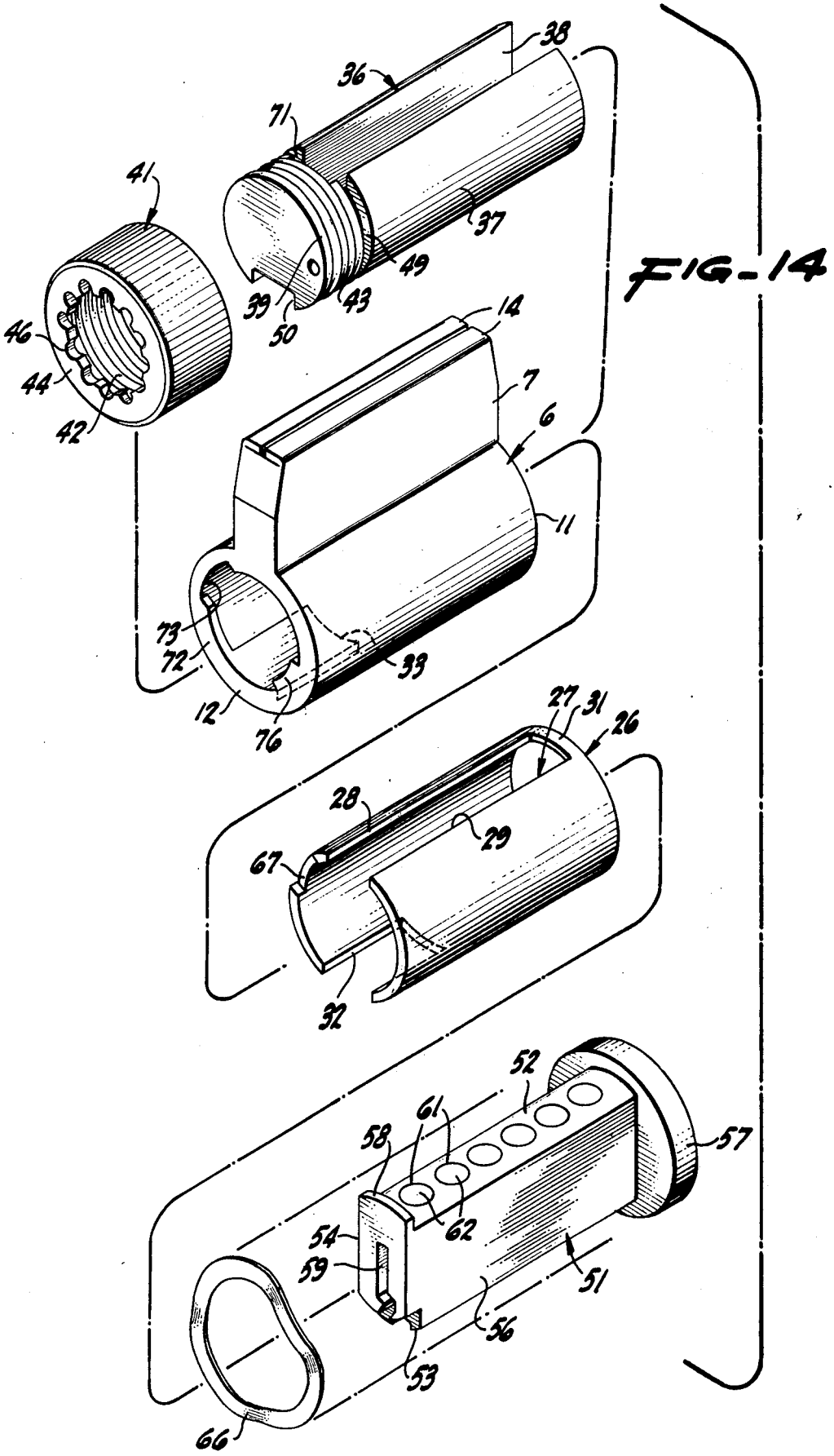
FIG. 14 is an exploded and folded isometric perspective view showing the various parts separated but as they are related along the main axis of the housing.

The parts as so far described are preferably subassembled by first loading the pins 62 into the chambers 61, preferably with the key 63 in place, and then putting a wavy washer 66 onto the plug core 51 tightly against the disc 57. The plug core with the washer 66 is then inserted, as shown by the connecting center line in FIG. 14, into the sleeve 26. The sleeve is upright with the slot at the top. The plug core axis can be initially tilted slightly to hook the lug 58 under the bridge 31, and the parts can then slide together coaxially.

When the plug core is substantially in position within the sleeve, the plug core is rotated slightly (say, 60° from an upright position and clockwise when looking at the disc 57), so that the lug 58 at one end of the plug core is in registry with a notch 67 in the sleeve just one side of the slot 27 therein. After the plug core has been inserted through the sleeve and rotated relative to the sleeve until the lug is in registry with the notch 67, the assembly force is relaxed. The spring 66 then expands sufficiently to move the plug core 51 axially with respect to the sleeve and to bring the lug into the notch 67. This interengages the plug core and the sleeve so that they are no longer capable of relative rotation. The sleeve overlies and retains the pins 62.

For disassembly, the plug core 51 is moved in the opposite axial direction with respect to the sleeve and compresses the spring. The lug 58 is thus removed from the notch 67, and the two parts are then rotated and are freed by axial displacement. For further assembly, however, the plug core and sleeve are put together in pin retaining position with the lug 58 in the notch 67.

After assembling the plug core and sleeve, the plug shell 36 can be subassembled with the housing. The plug shell is rotated about its axis approximately 60° clockwise and is axially introduced into the housing in which the springs 16 and pins 17 have already been positioned and temporarily retained by the usual assembly rod or fixture. The assembly continues until a shoulder 71 partly defining the groove 49 is adjacent an inturned flange 72 at one end of the housing 6. The flange has a cut-out window 73 at the 60° clockwise position, and has an inturned tab 76 diametrically opposite the window adapted to extend into and run in the groove 49 principally against the shoulder 71. The flange 72 has a bore just large enough to pass the threads 39. The plug shell can come to rest upon axial assembly with the shoulder 71 near the interior of the inturned flange 72.

The adjusting cap 41 is then screwed upon the projecting threads 43 just after the driver cap 47 and the driver bar 48 have been positioned against the end of the plug shell. The adjusting cap is brought home, and its inner rim then rests adjacent the outside of the inturned flange 72, thus holding the plug shell against axial movement in one direction within the housing 6, but permitting free relative rotation.

The subassembly of the plug core 51 and of the sleeve 26 is then introduced axially into the housing with the plug core 51 fitting exactly into the recess 38. The slot 27 engages with and slides along the rib 21. With the lug 58 in the notch 67 and the rib 21 in the slot 27, the lug 58 on the end of the plug core registers with the cut-out window 73 in the inturned flange 72. The tab 76 registers with the slot 50 and with a cut-out adjacent the surface 53.

The subassembly can be moved home axially until the disc 57 is near abutment with the end face 11 of the housing 6 and the lug 58 is fully displaced through th window 73. The subassembly of the plug core and the sleeve are then rotated back, the plug shell rotating away from and uncovering the upper pins, and the plug core bringing the lower pins 62 from under the sleeve 26. Rotation continues until the second, lower tumbler mechanism pins 62 are coplanar with the first, upper tumbler pins in the wing.

During this time, the lug 58 rides over the exterior or end face 12 of the inturned flange at the end of the housing 6. In normal assembled position the lug prevents axial motion in one direction of the plug core, while the disc 57 prevents endwise motion in the opposite direction.

When the parts are assembled, it can be considered that the plug shell 36 and the plug core 51 operating together are substantially equivalent to the normal rotary plug in a cylindrical lock of this general type, but a salient difference is that the plug herein is divided into two axially separable portions, the plug shell 36 and the plug core 51.

Figure 9:
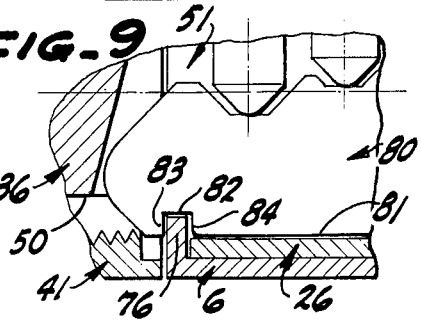
FIG. 9 is a view like FIG. 8 but showing a regular or standard key in position.
Figure 10:
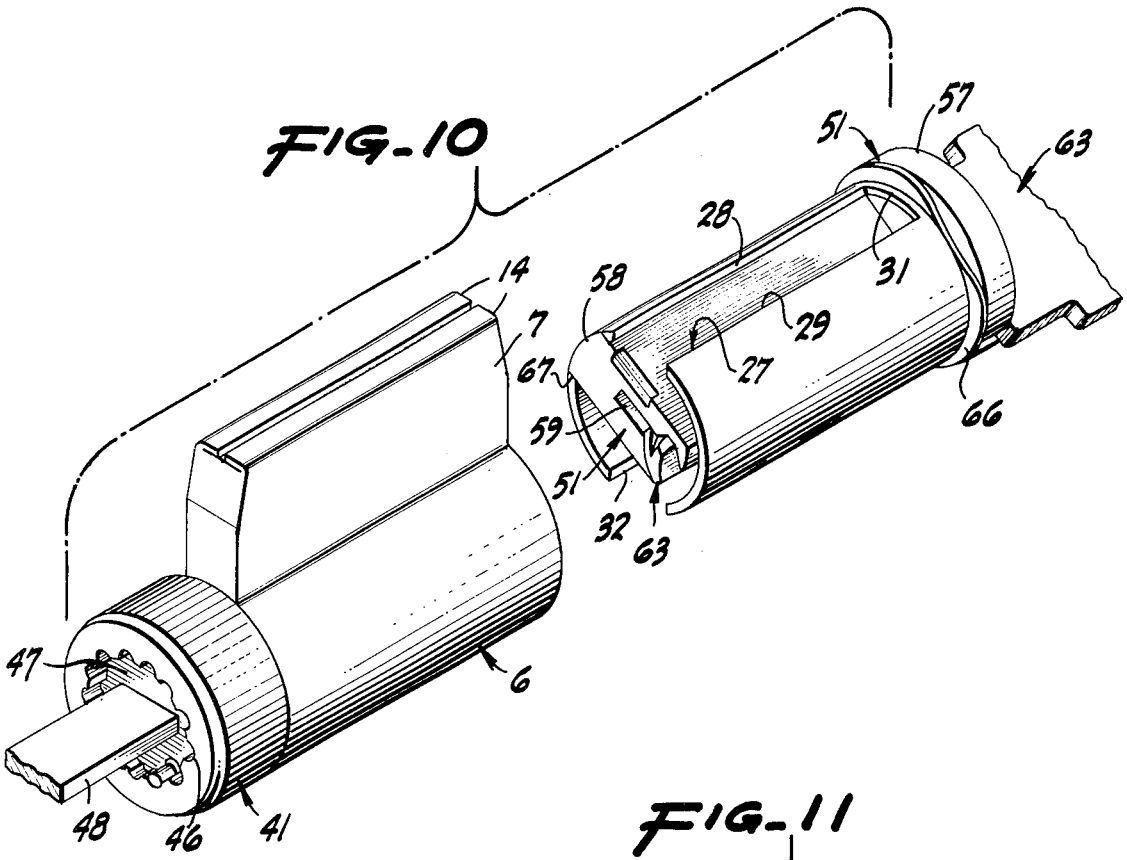
FIG. 10 is an exploded, isometric perspective view showing the plug core and sleeve removed from the housing.
Figure 11:
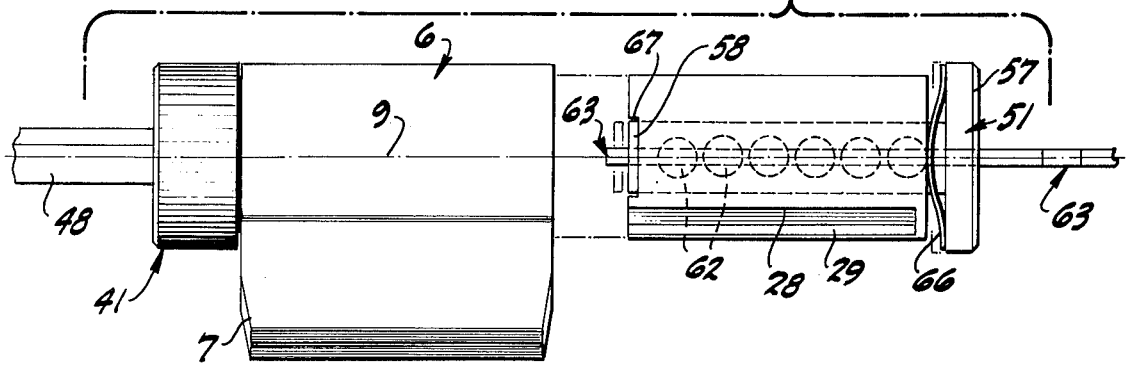
FIG. 11 is a view of the parts in the position shown in FIG. 10, the line of sight being perpendicular to the plane of the plug core and key bow.

For general use with the mechanism assembled as described, there is provided a standard key 80 (FIG. 9) that is much like the extraction key 63 except that along its lower, unserrated edge 81 it is interrupted by a transverse notch 82 defined between a pair of walls 83 and 84 extending normally to the axis 9 and of a size and configuration to interlock with the tab 76 and to rotate in the general plane of the inturned flange 72.

When the standard key 80 is introduced into the keyway fully, it operates all of the lower tumbler pins and the upper tumbler pins to provide the shear surface 65, so that the composite plug can be rotated upon rotation of the key. When first introduced, the key notch 82 does not interengage with the displaced sector end stop 76 because the key plane is generally vertical. As the key is turned (preferably clockwise), the plug core 51 and the plug shell 36 turn with it, but the sleeve 26 is restrained from rotation since it lies on opposite sides of the rib 21, and also the sides of the slot 32 are interengaged with the pad 33. Upon initial rotation, therefore, the lower pins 62 are rotated to lie under and to abut the interior surface of the sleeve 26.

During this initial rotation, the lug 58 travels along the exterior surface of the inturned flange 72 and eventually registers with the window 73. Since the lug 58 can move easily through the window 73, there is no longer any axial restraint by the lug 58 against withdrawal motion of the plug core, but at this rotational position the transverse notch 82 in the key rides over and interengages with the tab 76. The tab and key 80 thus preclude any axial withdrawal of the plug core and its associated mechanism.

As rotation of the key 80 continues past this point, although the notch 82 leaves its interconnection with the tab 76, nevertheless the lug 58 reengages with the outer surface of the inturned flange 72 for the remaining portion of the key rotation. This rotation of the key rotates the driver bar 48 sufficiently to perform the desired function of the lock. The key 80 can then return in the reverse direction to its initial starting point, axial dislodgement of the plug core always being prevented by interengagement of the wall 83 of the key notch with the tab 76 or of the lug 58 with the inturned flange 72. The key can be withdrawn after a normal lock operation.

The described function of the mechanism with the regular key 80 is no different from the operation of any standard cylindrical plug lockset, and the appearance of the mechanism as well as its operation do not indicate any difference except possibly for the notch 82 in the key.

Figure 8:
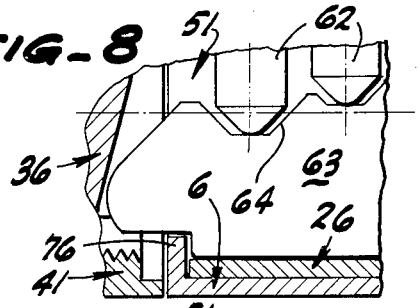
FIG. 8 is a detailed view, portions being broken away, comparable to FIG. 1, and showing an extraction key in position.

There is also provided, as shown in FIG. 1 and in FIG. 8, a special or extraction key 63 utilized to change the plug core and so change the combination. When the parts are in their normal starting position and after the key 80 has been withdrawn, the key 63 can be inserted fully. This key has the same serrated margin 64 as does the key 80 and so positions the lower tumbler pins and the upper tumbler pins again to set up the shear surface 65. The user can then rotate the key 63 in a direction clockwise to him as he faces the lock. This produces rotation of the plug core 51 exactly as before, causing the lower pins 62 to ride under and abut against the interior surface of the sleeve 26 along one side of the slot 27.

In approximately this position, the plug shell 36 has also been rotated far enough to displace the recess 38 and to move the solid part of the plug shell beneath the upper pins 17 to retain them. Also, the lug 58 has turned enough to register with the window 73 in the inturned flange 72. Whereas the key 80 had the wall 83 of the transverse notch 82 in engagement with the tab 76 in this rotary location, the key 63 has no such transverse notch wall, so does not interengage with the tab 76. Consequently, the user by pulling on the key bow can move the plug core 51 and the protecting sleeve 26 axially. This is easily accomplished because the serrations 64 are in interengagement with the lower pins 62 held tight at the shear surface 65 against the interior surface of the sleeve.

As the key 63 and the plug core are withdrawn, the lug 58 is moved axially entirely through the window 73 until it comes into registry with and seats within the notch 67. This is accompanied by some expansion of the spring 66. When the lug 58 is well seated in the notch 67, the sleeve is interlocked with the plug core against rotation. Further withdrawal movement of the key pulls the plug core 51 axially out from the plug shell 36 and carries the sleeve 26 with it. The tumbler pins 62 all are covered by the sleeve and are thus protected from dislodgment and assist in holding the plug core 51 and the key 63 together. The spring 66 maintains firm interengagement of the lug 58 in the notch 67. When this subassembly has been withdrawn, it can readily be replaced by a different subassembly of a similar plug core 51 but having different pins 62 in engagement with a key similar to the key 63 but having a different pattern of serrations 64.

Figure 3:
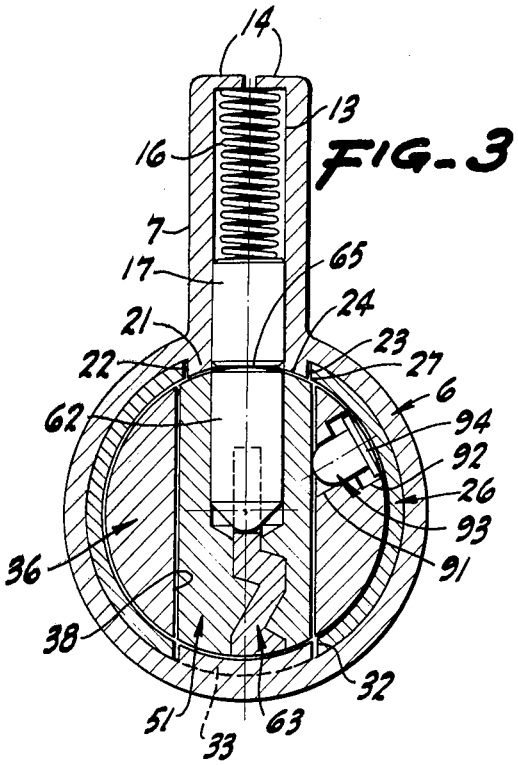
FIG. 3 is a cross-section, the plane of which is indicated by the line 3—3 of FIG. 1.
Figure 5:
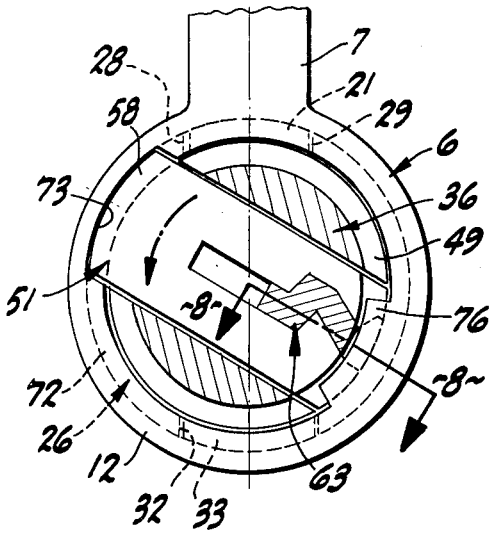
FIG. 5 is a cross-section like FIG. 2 but with some parts in a different position.
Figure 6:
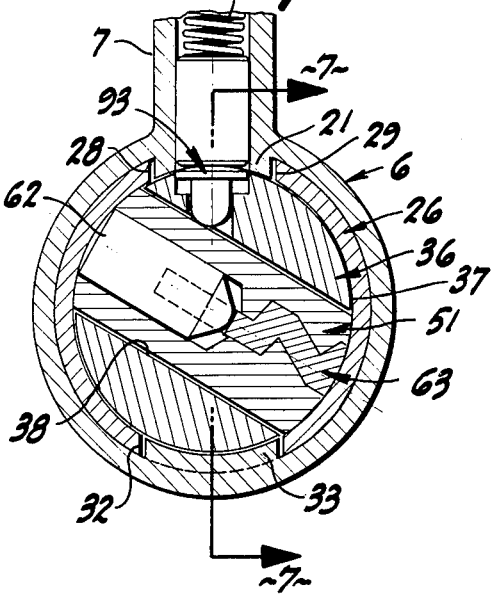
FIG. 6 is a cross-section like FIG. 3 but with some parts in a different position.
Figure 4:
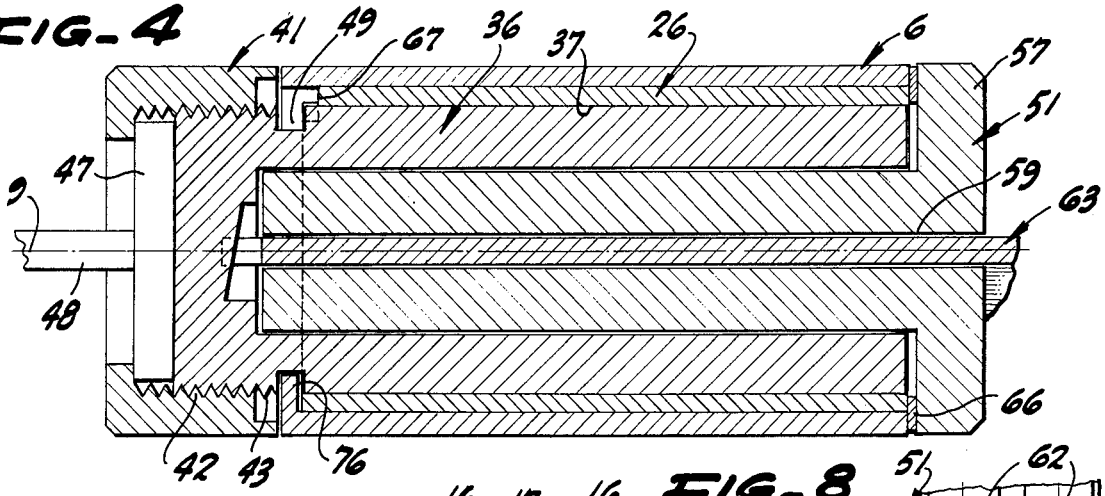
FIG. 4 is a cross-section, the plane of which is indicated by the line 4—4 of FIG. 2.
Figure 7:
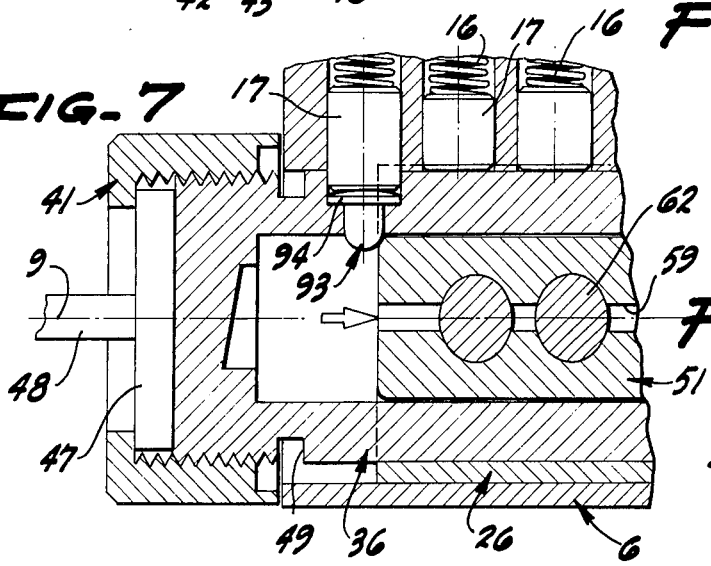
FIG. 7 is a detailed cross-section, portions being broken away, the plane of section being indicated by the line 7—7 of FIG. 6.

When the initial plug core and sleeve are withdrawn and before the replacement plug core and sleeve are introduced, the plug shell 36 is kept in position axially and is kept oriented in a polar fashion. This keeps the upper pins 17 protected and in place. One means of accomplishing this is illustrated in FIGS. 3, 6 and 7, particularly. As especially shown in FIG. 3, the plug shell 36 in a convenient location, preferably 60° counterclockwise, has an angled radial bore 91 with an enlarged portion 92 serving as a capture compartment for a pin 93 having a rounded end and having a curved cap 94. Under usual conditions the pin is well captured and simply rotates with the plug shell. When the plug shell is rotated into a position with the plug core 51 so that the lug 58 is able to go through the window 73, then the bore 91 is in alignment, as shown in FIG. 6, with one of the upper tumbler pins 17. There is no interaction of the pin 17 at that point unless and until the plug core 51 is withdrawn. Then, as shown particularly in FIG. 7, as the plug core 51 moves axially out of the recess 36, there is no longer any support by the plug core 51 of the pin 93. Then, by spring pressure and by gravity, the pin 93 falls into the vacated recess 38. The upper tumbler pin 17 in registry with the pin 93 is urged toward the axis by its spring 16 and descends past the shear line to enter into the enlarged portion 92 of the bore and so interlocks the plug shell 36 against rotation and against axial motion.

When the same or a subsequent plug core 51 is reintroduced into the plug shell 36, then the leading end of the plug core cams against the rounded end of the pin 93 and forces the pin radially outwardly into its initial position, at the same time lifting the upper tumbler pin 17 against the urgency of the spring 16 into its former position coincident with the shear line 65. Thus, when there is no plug core in position in the mechanism, the plug shell is locked against rotation or dislodgement. Upon restoration of a plug core, the parts are freed for operation as before.

Figure 13:
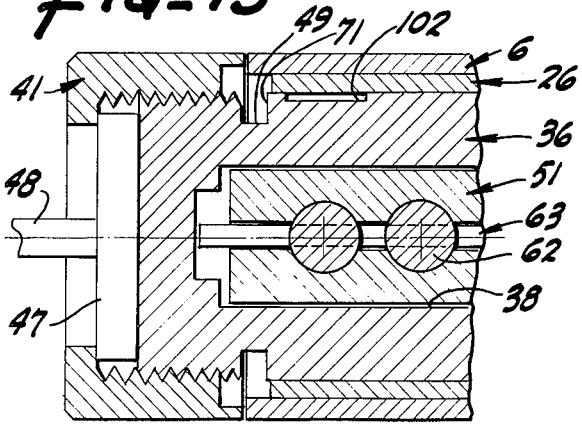
FIG. 13 is a cross-section, the plane of which is indicated by the line 13—13 of FIG. 12.
Figure 12:
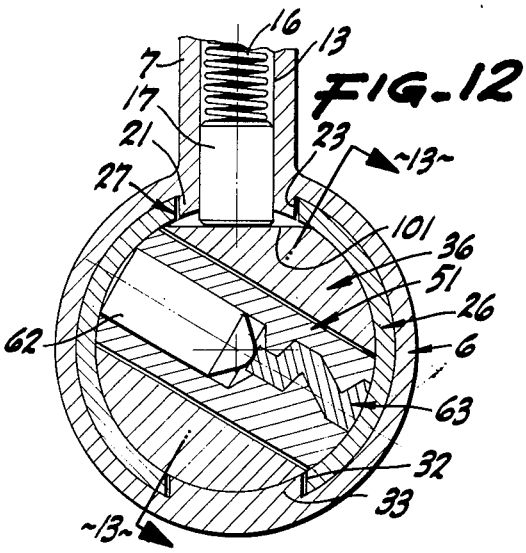
FIG. 12 is a cross-section normal to the housing axis and showing a variant form of retaining device for the plug shell.

As an alternative retainer, as shown in FIGS. 12 and 13, the plug shell 36 is formed with a special surface 101 thereon affording a partial peripheral groove 102. The groove 102 is in the same normal plane as or is in registry with one of the upper tumbler pins 17. Whenever the rotary mechanism is in the withdrawal position shown in FIG. 12, the associated pin 17 drops below the shear line and into endwise engagement with the walls of the groove 102, thus precluding endwise or axial motion of the plug shell. Rotation of the plug shell is not absolutely prevented, but is inhibited by resistance of the spring 16 to lifting of the pin 17 as the plug shell rotates. In this arrangement there is no interconnection between the plug core and the restraining device.

With the arrangement as described, there has been provided a structure virtually interchangeable with a standard pin tumbler cylindrical lock mechanism, which can be utilized as a substitute for such a standard mechanism, yet which affords the opportunity to remove a portion of the tumbler or combination structure for change. Further, the keys utilized are substantially standard and the external appearance of the structure has not been visibly altered. The installation and functioning of the structures are straight-foward and readily recognized and understood, and their manufacture can be carried out with mechanism of the sort already utilized for the manufacture of standard pin tumbler cylindrical lock mechanisms.

I claim:

1. A lock comprising a lock housing having therein a bore concentric with an axis, means in said lock housing and open to said bore including a first tumbler mechanism, a plug in said bore and rotatable about said axis, said plug including a plug shell and a plug core movable relative to each other in the direction of said axis, a second tumbler mechanism complementary to said first tumbler mechanism and disposed in said plug core, means for retaining said plug core against axial removal from said housing except in one rotated position of said plug core relative to said housing, said retaining means including an inturned flange on said housing extending toward said bore, means defining an axial window in said flange, and said retaining means including a lug on said plug core adapted to rotate against said flange and to pass axially through said window.

2. A device as in claim 1 in which said plug core has a disc at one end adapted substantially to abut one end of said housing, and said inturned flange is at the other end of said housing.

3. A device as in claim 2 in which said housing has an inturned tab and said key has a transverse notch therein adapted to embrace said tab.

4. A lock comprising a lock housing having therein a bore concentric with an axis, means in said lock housing and open to said bore including a first tumbler mechanism, a plug in said bore and rotatable about said axis, said plug including a plug shell and a plug core movable relative to each other in the direction of said axis, a second tumbler mechanism complementary to said first tumbler mechanism and disposed in said plug core, means for retaining said plug core against axial removal from said housing except in one rotated position of said plug core relative to said housing, means for holding said plug shell against axial displacement in said housing except in a predetermined rotary position of said plug shell in said housing, said holding means including an inturned flange on one end of said housing, a tab on said housing in said position, means defining a slot in said plug shell adapted to pass over said tab, and a cap engaging said plug shell and adapted to abut the other side of said inturned flange.

5. A device as in claim 4 in which said tab is inturned on said flange and said plug shell has means forming a circumferential groove adapted to pass over said tab.

6. A lock comprising a lock housing having therein a bore concentric with an axis, means in said lock housing and open to said bore including a first tumbler mechanism, a plug in said bore and rotatable about said axis, said plug including a plug shell and a plug core movable relative to each other in the direction of said axis, a second tumbler mechanism complementary to said first tumbler mechanism and disposed in said plug core, means for retaining said plug core against axial removal from said housing except in one rotated position of said plug core relative to said housing, a coaxial sleeve interposed in said bore between said plug and said housing, means for precluding relative rotation between said sleeve and said housing, said precluding means including walls of an axially extending open end recess and an axially extending rib interengaged between said sleeve and said housing.

7. A device as in claim 6 including means for precluding relative rotation between said sleeve and said plug core.

8. A device as in claim 7 in which said precluding means is an axially extending notch in one end of said sleeve and a radial lug on one end of said lug core adapted to enter into said notch axially.

9. A device as in claim 8 including a spring interposed between said plug core and said sleeve and urging said lug to enter said notch.

10. A lock comprising a cylindrical housing having a bore concentric with an axis and having an outer end and an inner end, a first tumbler mechanism in said housing, a plug shell rotatable in said housing about said axis and having an axially extending slot therein open adjacent said outer end, first means on said plug shell limiting axial movement of said plug shell toward said outer end, means releasably engaging said plug shell limiting axial movement of said plug shell toward said inner end, a plug core having a keyway therein and receivable in said slot, means on said plug core limiting axial movement of said plug core toward said inner end, a second tumbler mechanism in said plug core, and second means on said plug core limiting axial movement of said plug core toward said outer end except in one rotated position of said plug shell relative to said housing.

11. A device as in claim 10 in which said first means for limiting is a removable cap on said plug shell adapted to abut said inner end of said housing.

12. A device as in claim 11 in which said second means for limiting is releasable only in said one rotated position of said plug shell.

13. A device as in claim 11 including a cylindrical sleeve coaxially disposed around at least a portion of said plug core and movable axially and rotatably relative thereto.

14. A device as in claim 13 including releasable means for preventing relative rotation of said sleeve and said plug core.

15. A device as in claim 14 in which said releasable means includes an interengaging lug and notch on said sleeve and said plug core separable by relative axial motion of said sleeve and said plug core.

16. A device as in claim 15 including a spring between said limiting means on said plug core and an end of said sleeve.

17. A device as in claim 10 in which said second means limiting axial movement of said plug core includes an inturned flange on said housing concentric with said axis and having a window therein, and a lug on said plug core adapted axially to abut said inturned flange and movable axially through said window.

18. A device as in claim 10 including a sleeve in said bore and concentric with said axis, means defining an axial slot in said sleeve, and an axial rib on said housing projecting into said slot.

19. A device as in claim 18 in which said rib is in registry with said first tumbler mechanism.

20. A lock comprising a housing having a bore therein concentric with an axis, a radially extending wing on said housing, an axial rib on said housing registering with said wing and extending radially into said bore, a first tumbler mechanism in said wing and including first tumbler pins movable radially through said rib into said bore, a sleeve in said bore concentric with said axis, means defining an axial slot in said sleeve adapted to receive the sides of said rib, a plug shell concentric with said axis and rotatable within said sleeve into a rotary position abutting said first tumbler pins, means defining an axially extending recess in said plug shell, a plug core having a cylindrical surface and adapted substantially to occupy said recess and rotatable with said plug shell about said axis, means defining a keyway extending along said axis in said plug core, a second tumbler mechanism in said plug core including second tumbler pins movable radially in said plug core through said surface thereof and into said keyway and rotatable with said plug core to underlie said sleeve.

21. A device as in claim 20 including a key adapted to lie in said keyway, means defining a transverse notch in said key, and transverse means on said housing engaging in said notch in one rotary position of said plug core in said housing.

22. A device as in claim 21 in which said rotary position is with said second tumbler mechanism substantially out of abutment with said first tumbler mechanism.

23. In a lock mechanism, a housing having a bore, a first tumbler mechanism in said housing and opening to said bore, a plug having a first part and a second part rotatable together in said bore, means defining a keyway in said second part of said plug, a second tumbler mechanism in said second part of said plug complementary to said first tumbler mechanism and opening to said keyway and to the surface of said plug, and means effective in one rotary position of said plug in said bore for axially releasing said first part of said plug from said housing.

24. A removable core cylinder for a lock comprising a housing having a bore therein extending along an axis, a wing on said housing, an axial rib on said housing within said bore and substantially coextensive with said wing, means defining upper chambers in said wing and said rib opening into said bore, upper tumbler pins in said chambers, springs in said chambers urging said upper tumbler pins toward said axis, an inturned flange on the inner end of said housing and having a window therein, a plug shell rotatable in said bore, said plug shell including axially extending walls defining a slot in at least one rotated position of said plug shell in said housing being substantially coextensive with said rib, a cap engaging said plug shell and substantially abutting the inner side of said flange, a plug core adapted to lie in said slot, a disc on the outer end of said plug core, means defining lower chambers in said plug core adapted to register with said upper chambers, lower tumbler pins in said lower chambers, means defining a keyway in said disc and in said plug core open to said lower chambers, a cylindrical sleeve adapted to be disposed around said plug shell and around said plug core and axially movable relative to said plug core, means on said sleeve defining a slot adapted to engage said rib, means defining a notch at the inner end of said sleeve, a lug on said plug core, a spring between said disc and said sleeve urging interengagement between said sleeve notch and said lug, means interengaging said plug shell and said housing against relative axial movement, and means actuated by said plug core for disabling said interengaging means.

* * * * *